US007585203B1

(12) United States Patent
Shim

(10) Patent No.: US 7,585,203 B1
(45) Date of Patent: Sep. 8, 2009

(54) BOWLING BALL SURFACE TREATMENT MACHINE AND BOWLING BALL SURFACE TREATMENT METHOD

(76) Inventor: Sang-Bae Shim, 101-1702, HansolGangbyun Apt., Deokso-ri, Wabu-eup, Namyangju-si, Gyeonggi-do 472-901 (KR)

( * ) Notice: Subject to any disclaimer, the term of this patent is extended or adjusted under 35 U.S.C. 154(b) by 0 days.

(21) Appl. No.: 12/145,191

(22) Filed: Jun. 24, 2008

(51) Int. Cl.
*B24B 49/00* (2006.01)
*B24B 1/00* (2006.01)

(52) U.S. Cl. ..... 451/5; 451/50; 451/283; 451/285

(58) Field of Classification Search ..... 451/5, 451/50, 283, 285
See application file for complete search history.

(56) References Cited

U.S. PATENT DOCUMENTS

| | | | | |
|---|---|---|---|---|
| 2,405,344 | A * | 8/1946 | Cloutier | 451/50 |
| 2,479,898 | A * | 8/1949 | Beaudette | 15/93.1 |
| 3,714,703 | A * | 2/1973 | Maples | 29/560 |
| 3,971,164 | A * | 7/1976 | Albin et al. | 451/283 |
| 5,299,394 | A * | 4/1994 | Surdacki | 451/50 |
| 5,484,329 | A * | 1/1996 | Engelbrektson | 451/523 |
| 5,613,896 | A * | 3/1997 | Haus et al. | 451/50 |
| 6,186,875 | B1 * | 2/2001 | Cook et al. | 451/268 |
| 6,402,600 | B1 * | 6/2002 | Besch | 451/268 |
| 6,746,315 | B2 * | 6/2004 | Klukos | 451/50 |
| 7,063,607 | B2 | 6/2006 | Sim | |
| 2002/0168925 | A1 * | 11/2002 | Klukos | 451/49 |
| 2003/0049996 | A1 * | 3/2003 | Nam | 451/178 |
| 2006/0111029 | A1 * | 5/2006 | Sim | 451/491 |
| 2009/0098809 | A1 * | 4/2009 | Shim | 451/66 |

FOREIGN PATENT DOCUMENTS

KR 100242493 B1 11/1999

* cited by examiner

*Primary Examiner*—Maurina Rachuba
(74) *Attorney, Agent, or Firm*—Lowe Hauptman Ham & Berner

(57) ABSTRACT

A bowling ball surface treatment machine includes a housing and a ball movement guider provided inside the housing for guiding movement of a bowling ball, the ball movement guider having a guider center axis and an inner circumferential surface. A surface treatment disc with a surface treatment is arranged below the ball movement guider for supporting and rotating the bowling ball. The surface treatment disc has a disc center axis deviating from the guider center axis. The machine further includes a disc driving motor for rotating the surface treatment disc about the disc center axis and a controller for allowing the disc driving motor to repeatedly accelerate the surface treatment disc to a target rotation speed, rotate the surface treatment disc in a surface treatment position at the target rotation speed for a predetermined running time and then decelerate the surface treatment disc toward a zero speed.

8 Claims, 5 Drawing Sheets

BOWLING BALL SURFACE TREATMENT MACHINE AND BOWLING BALL SURFACE TREATMENT METHOD

FIELD OF THE INVENTION

The present invention pertains to a bowling ball surface treatment machine and, more specifically, to a bowling ball surface treatment machine capable of uniformly abrading or polishing a bowling ball with a simplified rotating structure. The present invention is also directed to a bowling ball surface treatment method using the bowling ball surface treatment machine.

BACKGROUND OF THE INVENTION

Frictional rolling contact between a bowling ball and a lane often leaves irregular wear portions or scratches on a surface of the bowling ball. In particular, the bowling ball tends to make contact with the lane substantially at the same circumferential area thereof, which may cause unbalanced wear of the bowling ball. The scratched or unevenly worn bowling ball looks ugly and use of the scratched or unevenly worn bowling ball makes it difficult for a bowler to exercise, e.g., spin skills at his or her desire due mainly to the unpredictable movement of the bowling ball. As a result, the scratch and the unbalanced wear may adversely affect the score of a bowling game, thus reducing amusement of the game played. Thus, the bowling ball needs to be periodically abraded into a perfect spherical shape with no or little scratch.

There are a number of prior art references that disclose a device for automatically abrading a bowling ball. One of them is U.S. Pat. No. 5,613,896 that teaches a bowling ball resurfacing machine including three shafts disposed at an angle of 120 degrees in such a manner as to support a bowling ball, three motors for rotating the corresponding shafts in a forward or reverse direction, and three cone-shaped abrading cups mounted on the shafts. Although this bowling ball resurfacing machine has its own advantages, it suffers from a drawback in that a rolling direction or a rotation axis of the bowling ball cannot be vigorously changed during a resurfacing process. For this reason, the bowling ball resurfacing machine encounters a difficulty in uniformly abrading the whole surface of the bowling ball into a perfect sphere.

Another prior art reference is U.S. Pat. No. 7,063,607 disclosing a bowling ball resurfacing machine that includes a housing, first and second vertical support rollers mounted to the housing for rotation about parallel vertical axes, each of the vertical support rollers adapted to make contact with the surface of the bowling ball at one lateral bottom side of the bowling ball, first and second horizontal support rollers mounted to the housing for supporting the bowling ball in cooperation with the vertical support rollers, each of the horizontal support rollers rotatable about horizontal axes and adapted to make contact with the surface of the bowling ball at the other lateral bottom side of the bowling ball, drive motors for causing the support rollers to rotate, and a grinding-and-polishing wheel assembly for making frictional contact with the surface of the bowling ball to grind or polish the bowling ball.

The prior art devices noted above are capable of substantially evenly abrading or polishing the surface of the bowling ball by rotating the bowling ball in different directions. However, the prior art devices leave a room for improvement because they are structurally complicated, costly to fabricate and highly susceptible to trouble.

SUMMARY OF THE INVENTION

In view of the above-mentioned or other problems inherent in the prior art devices, it is an object of the present invention to provide a bowling ball surface treatment machine and method capable of uniformly abrading or polishing the whole surface of the bowling ball within a shortened period of time.

Another object of the invention is to provide a bowling ball surface treatment machine which is quite simple in structure, easy to manufacture and low in price.

In accordance with one aspect of the present invention, there is provided a bowling ball surface treatment machine, comprising:

a housing;

a ball movement guider provided inside the housing for guiding movement of a bowling ball, the ball movement guider having a guider center axis and an inner circumferential surface for guiding movement of the bowling ball;

a surface treatment disc arranged below the ball movement guider for supporting and rotating the bowling ball, the surface treatment disc including a surface treatment element for making frictional contact with the bowling ball, the surface treatment disc having a disc center axis deviating from the guider center axis of the ball movement guider;

a disc driving motor for rotating the surface treatment disc about the disc center axis; and a controller for allowing the disc driving motor to accelerate the surface treatment disc to a target rotation speed, rotate the surface treatment disc in a surface treatment position at the target rotation speed for a predetermined running time and then decelerate the surface treatment disc toward a zero speed, in a repeated manner until a preset treatment time lapses.

In another aspect of the present invention, there is provided a bowling ball surface treatment method, comprising:

placing a bowling ball on a surface treatment disc off-centered from a ball movement guider, the surface treatment disc having a surface treatment element for making frictional contact with the bowling ball, the ball movement guider arranged above the surface treatment disc to guide movement of the bowling ball;

accelerating the surface treatment disc up to a target rotation speed to bring the bowling ball into a surface treatment position where the bowling ball lies farthest from a center axis of the surface treatment disc;

rotating the surface treatment disc in the surface treatment position at the target rotation speed for a predetermined running time so that the bowling ball can be surface-treated by the surface treatment element of the surface treatment disc;

decelerating the surface treatment disc toward a zero speed so that the bowling ball can be escaped from the surface treatment position and can be moved toward the center axis of the surface treatment disc; and repeating the accelerating step, the rotating step and the decelerating step until a preset treatment time lapses.

BRIEF DESCRIPTION OF THE DRAWINGS

The above and other objects and features of the present invention will become apparent from the following description of preferred embodiments given in conjunction with the accompanying drawings, in which.

DESCRIPTION OF THE PREFERRED EMBODIMENTS

Preferred embodiments of a bowling ball surface treatment machine and method in accordance with the present invention will now be described in detail with reference to the accompanying drawings.

Figure 1:
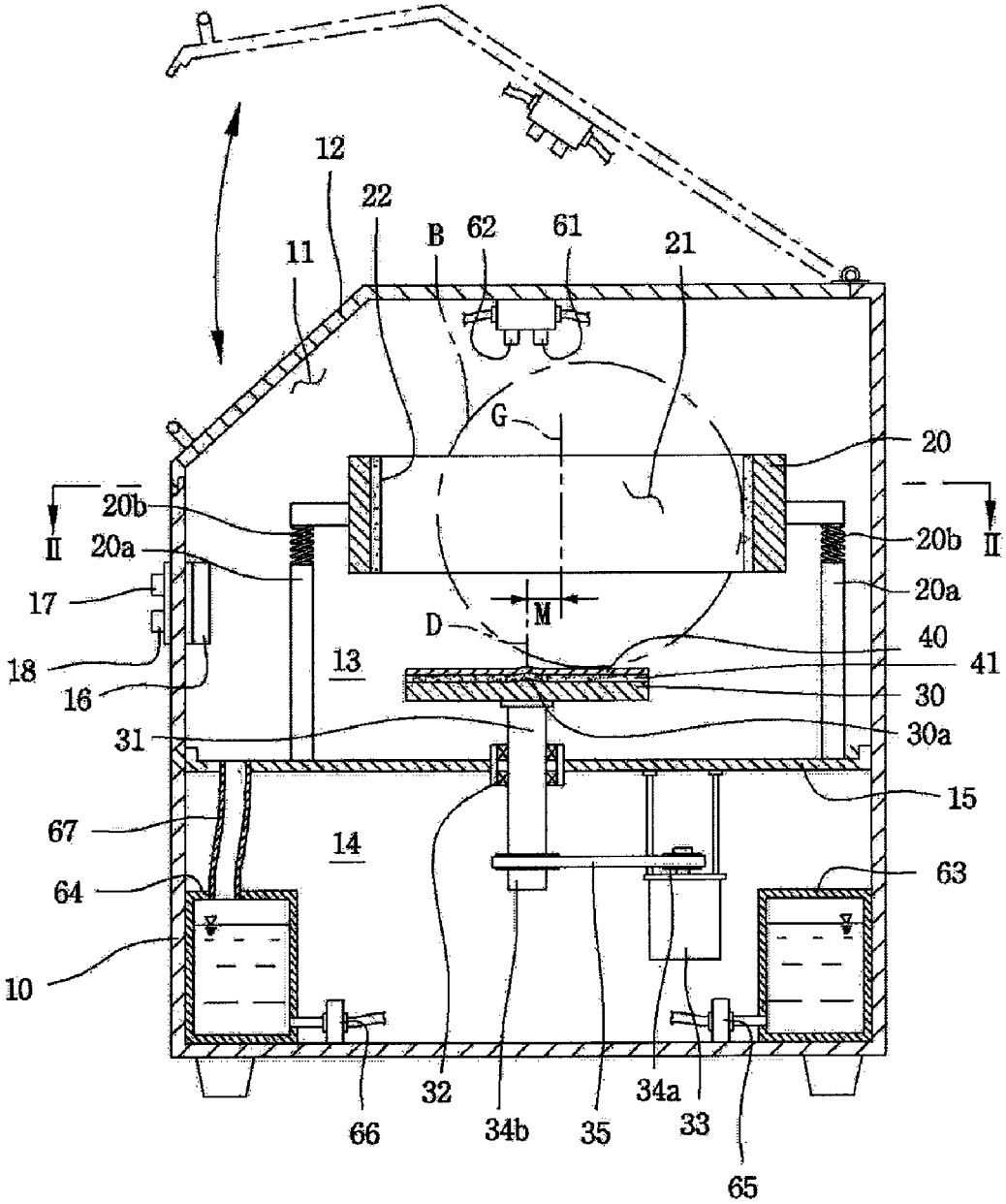
FIG. 1 is a side elevational section view showing a bowling ball surface treatment machine in accordance with the present invention.
Figure 2:
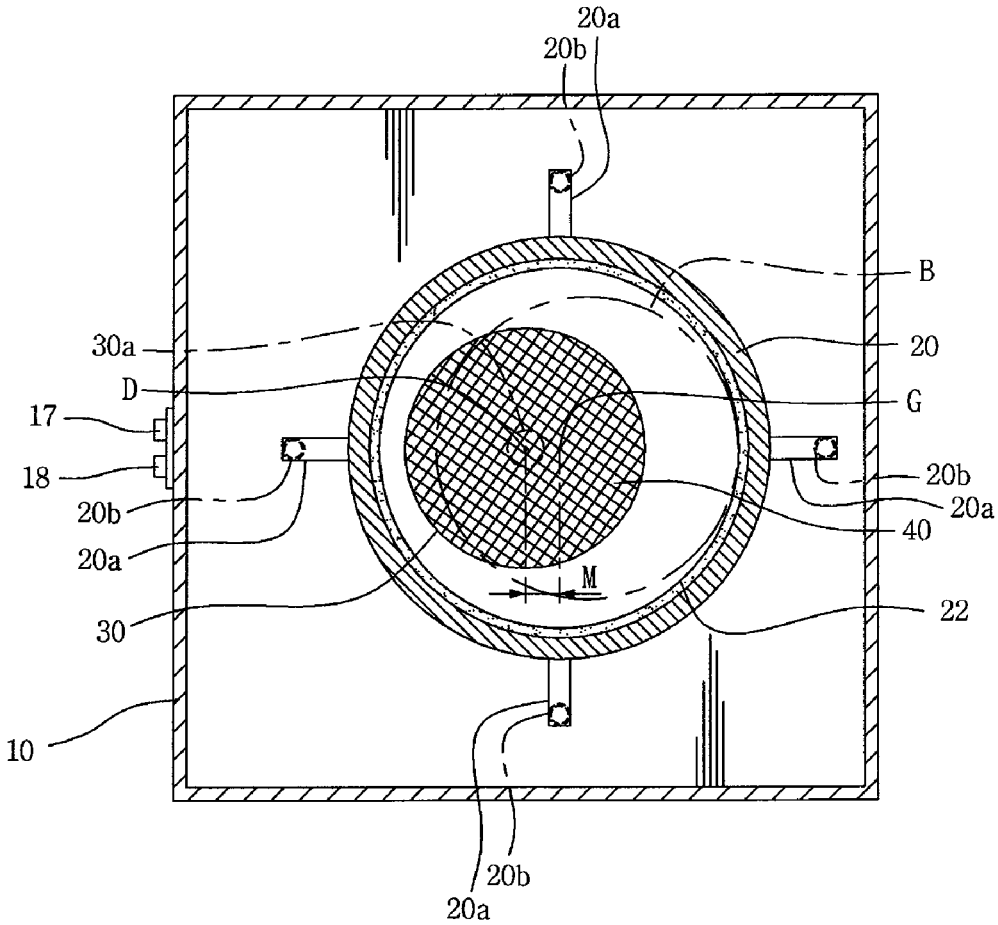
FIG. 2 is a cross sectional view of the bowling ball surface treatment machine taken along line II-II in FIG. 1.

Referring to FIGS. 1 and 2, a bowling ball surface treatment device includes a housing 10 having a top access opening 11 through which a bowling ball B is put into or taken out from the housing 10. The access opening 11 is openably closed by a lid 12. The housing 10 has an internal space divided into an upper surface treatment compartment 13 and a lower drive compartment 14 by means of a partition plate 15. With the surface treatment compartment 13, the bowling ball B is subjected to surface treatments such as abrading, polishing and the like. The drive compartment 14 is designed to receive a drive unit described later.

A controller 16 for controlling the operation of the bowling ball surface treatment machine is attached to an internal side surface of the housing 10. A series of push buttons 17 and a timer knob 18 for setting various operating conditions of the bowling ball surface treatment machine are arranged on an external side surface of the housing 10 and electrically associated with the controller 16.

Within the surface treatment compartment 13 of the housing 10, there is provided a generally ring-shaped ball movement guider 20 for guiding the movement of the bowling ball B and confining the bowling ball B within a limited surface treatment area. Although the ball movement guider 20 has a generally circular shape in the illustrated embodiment, it may have an elliptical shape, a polygonal shape or other irregular shape.

In the illustrated embodiment, the ball movement guider 20 having a guider center axis G is fixedly secured to the partition plate 15 by means of a plurality of rod-like support members 20*a* extending downwardly from the ball movement guider 20. Each of the support members 20*a* is provided with a coil spring portion 20*b* that serves to reduce vibration and noise which would be generated in the ball movement guider 20 during operation of the bowling ball surface treatment machine. Alternatively, the ball movement guider 20 may be attached to an inner wall surface of the housing 10 through a shock-absorber, e.g., a coil spring. Although four support members 20*a* are used in the illustrated embodiment, the number of the support members 20*a* may be greater or lesser.

The ball movement guider 20 has a ball reception opening 21 for rotatably and revolvably receiving the bowling ball B. The ball reception opening 21 is somewhat greater in diameter than the bowling ball B to ensure that the bowling ball B received in the ball reception opening 21 can move along the inner surface of the ball movement guider 20. A shock-absorbing liner 22 made of an elastically deformable material, e.g., a rubber strip, is detachably attached to the inner surface of the ball movement guider 20.

A surface treatment disc 30 is arranged below the ball movement guider 20 to support and rotate the bowling ball B. The surface treatment disc 30 is provided with a disc shaft 31 extending downwardly along a disc center axis D. The disc shaft 31 extends through the partition plate 15 into the drive compartment 14 and is rotatably supported on the partition plate 15 by means of a bearing 32. It is important to note that the disc center axis D deviates from the guider center axis G by a distance M. The surface treatment disc 30 has a central convex region 30*a* protruding upwardly from the upper surface of the surface treatment disc 30. The central convex region 30*a* serves to prevent the bowling ball B from staying at the midpoint of the surface treatment disc 30.

The surface treatment disc 30 has a surface treatment element that makes contact with the bowling ball B to perform surface treatments, i.e., abrading and/or polishing. In the illustrated embodiment, the surface treatment element is formed of a surface treatment fabric 40 and a cushion backing 41 attached to the surface treatment fabric 40.

Examples of the surface treatment fabric 40 include an abrading fabric such as a sheet of sandpaper or a sheet of diamond-coated paper and a polishing fabric such as a non-woven fabric or cotton fabric. The abrading fabric and the polishing fabric can be selectively used in abrading and polishing the bowling ball B. It is preferred that three kinds of abrading fabrics, i.e., fine, medium and coarse abrading fabrics, are used to abrade the bowling ball B with different roughness.

The cushion backing 41 is made of, e.g., a sponge material, which absorbs shock generated by the bowling ball B during a surface treatment process. The shock-cushion backing 41 is replaceably attached to the top surface of the surface treatment disc 30 by means of, e.g., a Velcro fastener.

The bowling ball surface treatment machine includes a disc rotating device for rotating the surface treatment disc 30 and the disc shaft 31 about the disc center axis D deviating from the guider center axis G. The disc rotating device includes a disc driving motor 33 provided within the drive compartment 14, a pair of pulleys 34*a* and 34*b* respectively fixed to an output shaft of the disc driving motor 33 and a lower end of the disc shaft 31, and a belt 35 wound around the pulleys 34*a* and 34*b* for transferring a torque of the disc driving motor 33 to the disc shaft 31 of the surface treatment disc 30.

The controller 16 is electrically connected to the disc driving motor 33 so that it can control the operation of the disc driving motor 33 in a specified manner. The controller 16 is designed to allow the disc driving motor 33 to operate the surface treatment disc 30 in three, i.e., first, second and third, consecutive operation steps. The first operation step is to cause the disc driving motor 33 to accelerate the surface treatment disc 30 up to a target rotation speed of, e.g., 400 to 1200 rpm, in a state that the bowling ball B is placed on the surface treatment disc 30. The second operation step is to cause the disc driving motor 33 to rotate the surface treatment disc 30 at the target rotation speed for a predetermined running time, e.g., 1 to 3 second, so that the bowling ball B can be rotated about a generally horizontal axis in a fixed surface treatment position farthest from the disc center axis D. During the second step, the bowling ball B is abraded or polished by making frictional contact with the radially outer surface region of the surface treatment disc 30. The third operation step is to cause the disc driving motor 33 to decelerate the surface treatment disc 30 from the target rotation speed down to a nearly zero or exactly zero rotation speed so that the bowling ball B can escape from the fixed surface treatment position and can roll across the surface treatment disc 30 radially inwardly of the latter. In the third step, the surface region of the bowling ball B that makes contact with the surface treatment disc 30 is changed to another region. The controller 16 is designed to repeat the first to third operation steps until a preset surface treatment time, e.g., five minutes, lapses. As the first to third operation steps are repeatedly performed, different surface regions of the bowling ball B are rubbed by the surface treatment disc 30 and, after all, the entire surface region of the bowling ball B is uniformly abraded or polished with no or little partial wear.

The bowling ball surface treatment machine includes a treatment solution supplying device for supplying surface treatment solutions to the bowling ball B. Two kinds of surface treatment solutions may be used in the bowling ball surface treatment machine. One is an abrading solution for use in abrading the bowling ball B and the other is a polishing solution for use in polishing the bowling ball B.

The treatment solution supplying device includes an abrading solution injection nozzle 61 for injecting the abrading solution to the surface of the bowling ball B, a polishing solution injection nozzle 62 for injecting the polishing solution to the surface of the bowling ball B, an abrading solution tank 63 for storing the abrading solution, a polishing solution tank 64 for storing the polishing solution, an abrading solution pump 65 for pumping the abrading solution stored in the abrading solution tank 63 to the abrading solution injection nozzle 61, and a polishing solution pump 66 for pumping the polishing solution stored in the polishing solution tank 64 to the polishing solution injection nozzle 62.

The abrading solution injection nozzle 61 and the polishing solution injection nozzle 62 are attached to the inner side of the lid 12 so that they can face the bowling ball B received within the surface treatment compartment 13. The abrading solution tank 63, the polishing solution tank 64, the abrading solution pump 65 and the polishing solution pump 66 are arranged within the drive compartment 14. The polishing solution tank 64 communicates with the surface treatment compartment 13 through a drain pipe 67 to collect the abrading solution and the polishing solution injected into the surface treatment compartment 13.

Next, a bowling ball surface treatment method in accordance with the present invention will be described with particular reference to FIGS. 3 to 7.

First, the operating conditions, e.g., the surface treatment time and the kind of surface treatments (abrading and polishing), are preset using the push buttons 17 and the timer knob 18.

Figure 3:
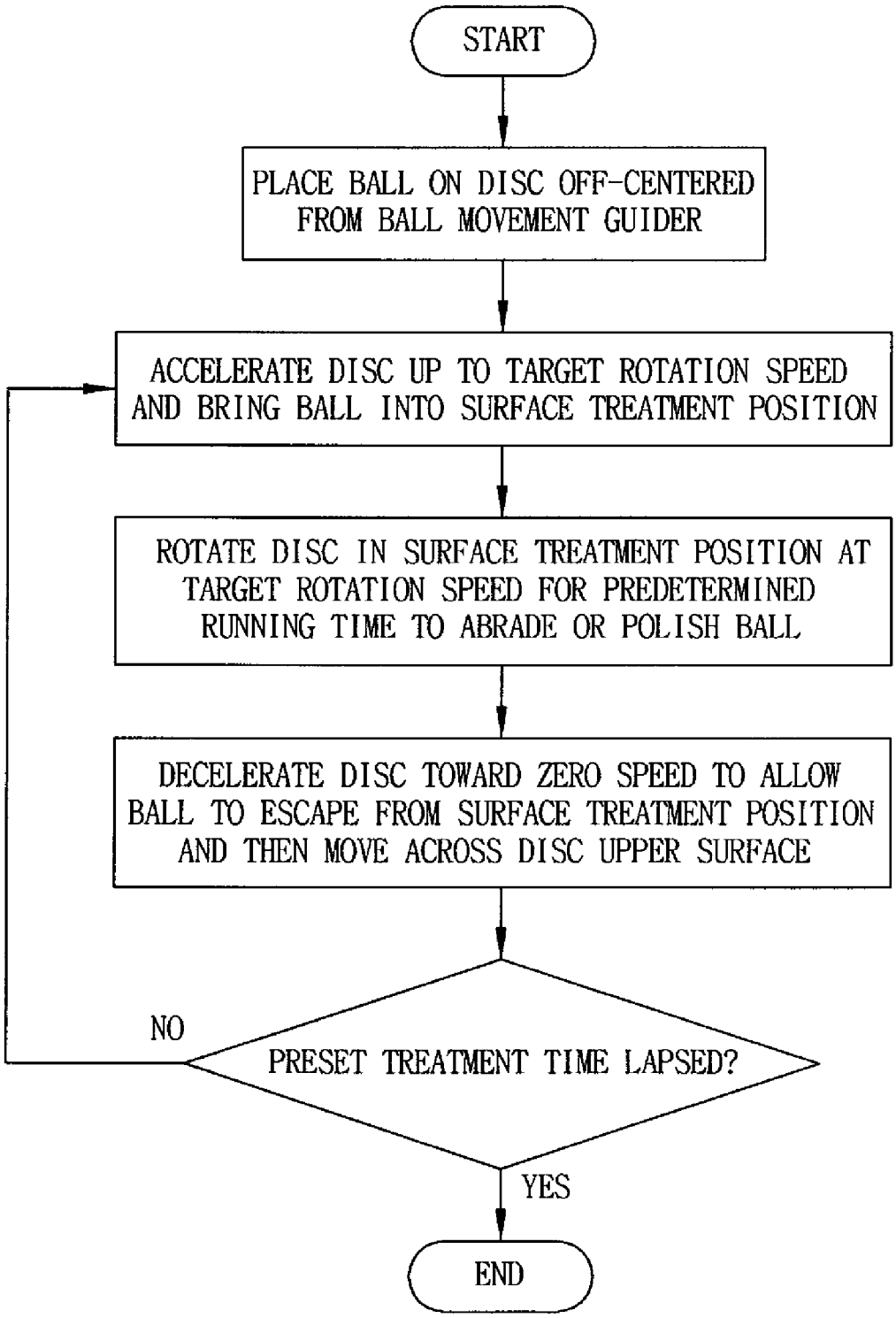
FIG. 3 is a flowchart illustrating a bowling ball surface treatment method in accordance with the present invention.
Figure 4:
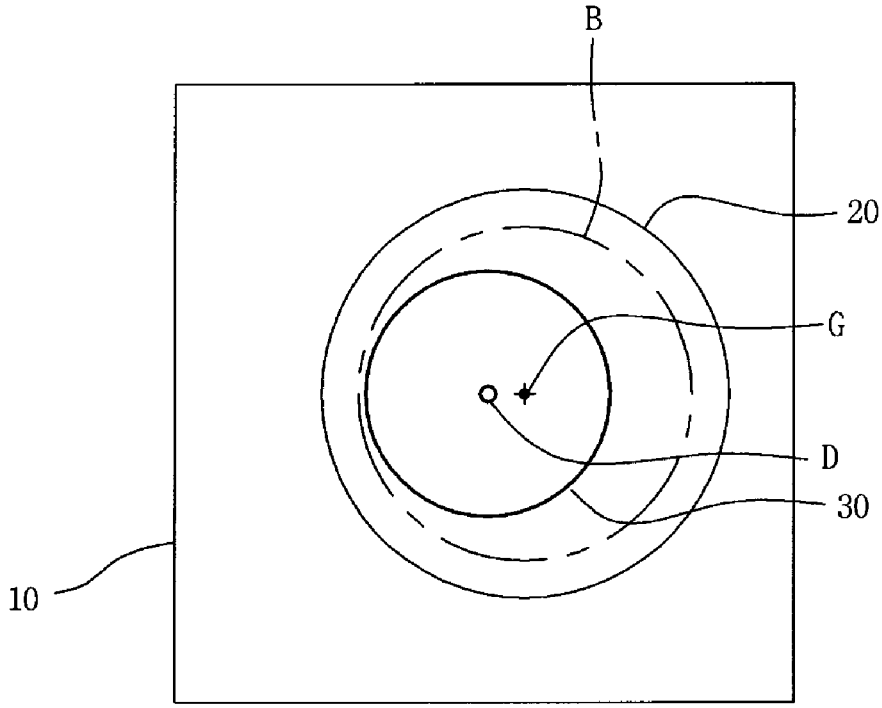
FIGS. 4 through 7 are schematic diagrams depicting the movement of a bowling ball during a surface treatment process performed by the bowling ball surface treatment machine of the present invention.

Referring to FIG. 3, the lid 12 is opened and the bowling ball B is placed on the surface treatment disc 30 off-centered from the ball movement guider 20 (S10). At this time, the bowling ball B may be placed in any position on the surface treatment disc 30 as shown in FIG. 4.

Figure 5:
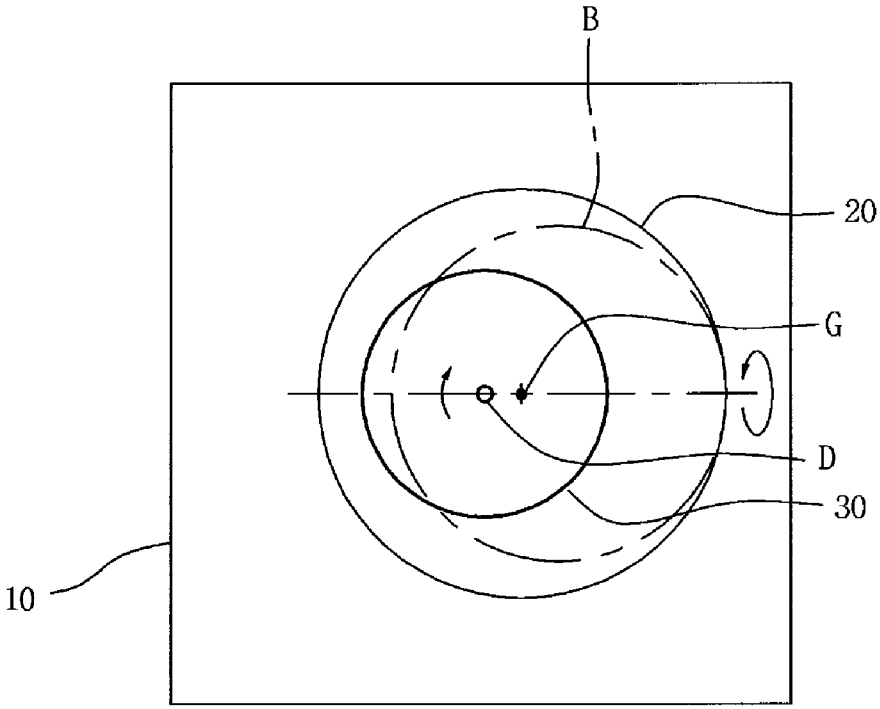

Then, the disc driving motor 33 is energized and rotatingly driven under the control of the controller 16. The torque of the disc driving motor 33 is transferred to the disc shaft 31 via the pair of pulleys 34*a* and 34*b* and the belt 35, thereby rotating the surface treatment disc 30 together with the disc shaft 31. The disc driving motor 33 accelerates the surface treatment disc 30 up to a target rotation speed of, e.g., 400 to 1200 rpm, to bring the bowling ball B into a surface treatment position as illustrated in FIG. 5 (S20 in FIG. 3). More specifically, as the surface treatment disc 30 is rotated and accelerated up to the target rotation speed, the bowling ball B is moved radially outwardly of the surface treatment disc 30 by a centrifugal force and then moved along the inner circumferential surface of the ball movement guider 20 until it reaches a surface treatment position as illustrated in FIGS. 2 and 5. In the illustrated embodiment, the surface treatment position refers to the 3 o'clock position where the bowling ball B stays farthest from the disc center axis D. This is because the disc center axis D deviates toward the 9 o'clock position from the guider center axis G by a distance M. Such a deviation between the disc center axis D and the guider center axis G ensures that the bowling ball B is kept stationary in the surface treatment position unless the rotation speed of the surface treatment disc 30 is decelerated to nearly zero or exactly.

Once the bowling ball B is moved into the surface treatment position as illustrated in FIG. 5, the disc driving motor 33 rotates the surface treatment disc 30 at the target rotation speed for a predetermined running time, e.g., 1 to 3 second, so that a specified surface region of the bowling ball B can be continuously abraded or polished by means of the surface treatment element of the surface treatment disc 30 (S30 in FIG. 3). In other words, the bowling ball B is surface-treated while it is rotated by the surface treatment disc 30 in the surface treatment position. During the predetermined running time, the bowling ball B is rotated about a generally horizontal axis so that the specified surface region of the bowling ball B can be rubbed by the surface treatment element of the surface treatment disc 30.

Figure 6:
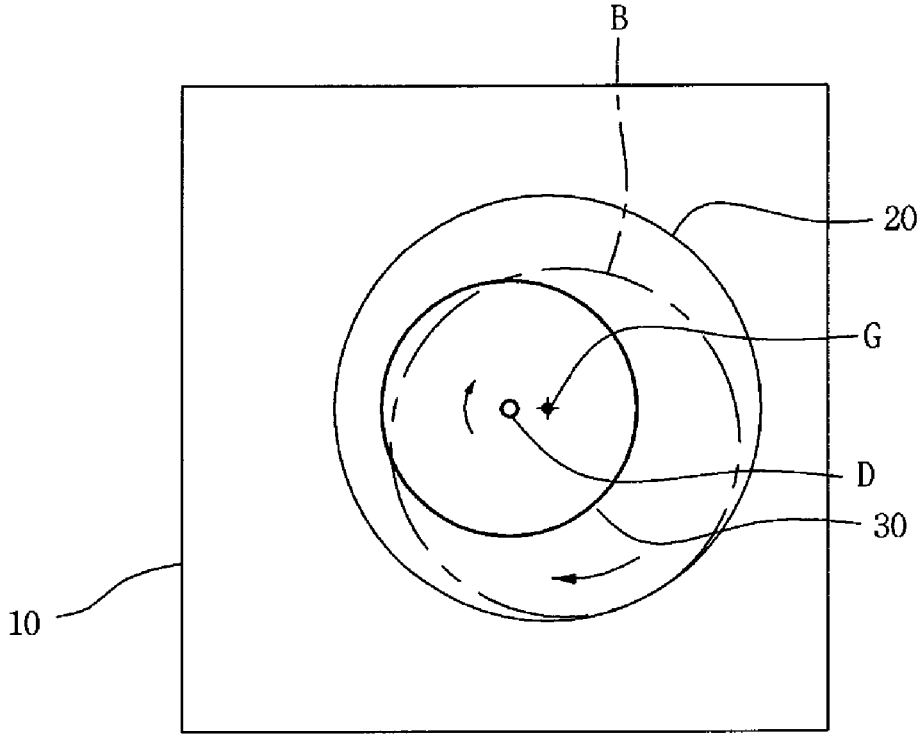
Figure 7:
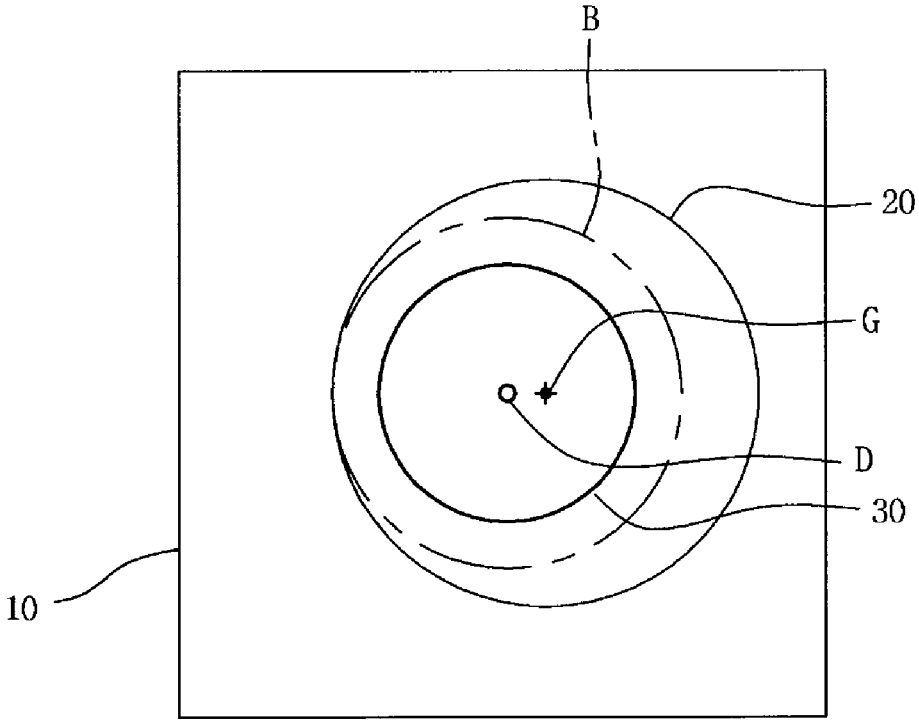

If the predetermined running time lapses, the controller 16 reduces the rotation speed of the disc driving motor 33 by reducing or cutting off an electric current supplied to the disc driving motor 33. Thus, the disc driving motor 33 decelerates the surface treatment disc 30 toward a zero speed (S40 in FIG. 3). As the surface treatment disc 30 is decelerated to nearly zero and is rotated at a very low speed, the centrifugal force acting against the bowling ball B is eliminated and the bowling ball B is moved together with the surface treatment disc 30 in a clockwise direction as illustrated in FIG. 6. Therefore, the bowling ball B is escaped from the surface treatment position and is moved radially inwardly toward the disc center axis D across the upper surface of the surface treatment disc 30. This is because the distance between the disc center axis D and the inner circumferential surface of the ball movement guider 20 grows smaller and smaller from the 3 o'clock position to the 6 o'clock position and then to the 9 o'clock position. When the bowling ball B is in the 9 o'clock position as illustrated in FIG. 7, the bowling ball B makes contact with the surface treatment disc 30 at a contact point closest to the disc center axis D. If the surface treatment disc 30 is accelerated again, the bowling ball B is rotated about a generally vertical axis together with the surface treatment disc 30 for a short moment. During the rolling movement of the bowling ball B across the upper surface of the surface treatment disc 30 and the rotational movement of the bowling ball B about the generally vertical axis, the surface region of the bowling ball B that makes contact with the surface treatment disc 30 is changed at random.

The controller 16 determines whether a preset treatment time, e.g., five minutes, has lapsed (S50 in FIG. 3). If the answer is in the negative, the controller 16 allows the disc driving motor 33 to repeat steps S20, S30 and S40. If the answer is in the affirmative, the controller deenergizes the disc driving motor 33, thereby terminating the flow of the bowling ball surface treatment method.

Although the determination step is performed just after step S40 in the illustrated embodiment, it may be possible to perform the determination step after step S20 or S30. When accelerating again the surface treatment disc 30 in step S20, the surface treatment disc 30 may be rotated in the reverse direction, i.e., in the counterclockwise direction.

With the surface treatment machine and method stated above, the surface treatment region of the bowling ball B is positively changed each time the rotation speed of the surface treatment disc 30 is decelerated to nearly zero or exactly zero. Therefore, the entire surface of the bowling ball B is uniformly abraded or polished by the surface treatment fabric 40 of the surface treatment disc 30 as the surface treatment operation continues to be performed.

The surface treatment method of the present invention is divided into an abrading method and a polishing method, which may be performed independently or in combination.

In the abrading method, an abrading fabric that constitutes the surface treatment fabric 40 is replaceably attached to the surface treatment disc 30. Coarse, medium and fine abrading fabrics may be selectively used to abrade the bowling ball B with different roughness. If needed, coarse abrading, medium abrading and fine abrading can be successively performed by attaching the coarse, medium and fine abrading fabrics to the surface treatment disc 30 one after another.

In the abrading method, the abrading solution stored in the abrading solution tank 63 is supplied by the abrading solution pump 65 to the surface of the bowling ball B through the abrading solution injection nozzle 61. In the polishing method, the abrading fabric is replaced by a polishing fabric that constitutes the surface treatment fabric 40. The polishing solution stored in the polishing solution tank 64 is supplied by the polishing solution pump 66 to the surface of the bowling ball B through the polishing solution injection nozzle 62.

While a preferred embodiment of the invention has been shown and described hereinabove, it will be understood by those skilled in the art that various changes and modifications may be made without departing from the spirit and scope of the invention as defined in the following claims.

What is claimed is:

1. A bowling ball surface treatment machine, comprising:

a housing;

a ball movement guider provided inside the housing for guiding movement of a bowling ball, the ball movement guider having a guider center axis and an inner circumferential surface for guiding movement of the bowling ball;

a surface treatment disc arranged below the ball movement guider for supporting and rotating the bowling ball, the surface treatment disc including a surface treatment element for making frictional contact with the bowling ball, the surface treatment disc having a disc center axis deviating from the guider center axis of the ball movement guider;

a disc driving motor for rotating the surface treatment disc about the disc center axis; and a controller for allowing the disc driving motor to accelerate the surface treatment disc to a target rotation speed, rotate the surface treatment disc in a surface treatment position at the target rotation speed for a predetermined running time and then decelerate the surface treatment disc toward a zero speed, in a repeated manner until a preset treatment time lapses.

2. The bowling ball surface treatment machine as recited in claim 1, wherein the inner circumferential surface of the ball movement guider is farthest from the disc center axis in the surface treatment position.

3. The bowling ball surface treatment machine as recited in claim 1, wherein the target rotation speed is in a range of 400 to 1200 rpm.

4. The bowling ball surface treatment machine as recited in claim 1, wherein the predetermined running time is 1 to 3 second.

5. The bowling ball surface treatment machine as recited in claim 1, wherein the housing has an internal space divided into an upper surface treatment compartment and a lower drive compartment by means of a partition plate, the ball movement guider including a plurality of support members fixedly secured to the partition plate, each of the support members having a coil spring portion.

6. A bowling ball surface treatment method, comprising:

placing a bowling ball on a surface treatment disc off-centered from a ball movement guider, the surface treatment disc having a surface treatment element for making frictional contact with the bowling ball, the ball movement guider arranged above the surface treatment disc to guide movement of the bowling ball;

accelerating the surface treatment disc up to a target rotation speed to bring the bowling ball into a surface treatment position where the bowling ball lies farthest from a center axis of the surface treatment disc;

rotating the surface treatment disc in the surface treatment position at the target rotation speed for a predetermined running time so that the bowling ball can be surface-treated by the surface treatment element of the surface treatment disc;

decelerating the surface treatment disc toward a zero speed so that the bowling ball can be escaped from the surface treatment position and can be moved toward the center axis of the surface treatment disc; and repeating the accelerating step, the rotating step and the decelerating step until a preset treatment time lapses.

7. The bowling ball surface treatment method as recited in claim 6, wherein the target rotation speed is in a range of 400 to 1200 rpm.

8. The bowling ball surface treatment method as recited in claim 6, wherein the predetermined running time is 1 to 3 second.

* * * * *